US005740591A

United States Patent [19]

Hopkins

[11] Patent Number: 5,740,591

[45] Date of Patent: Apr. 21, 1998

[54] QUICK RELEASE LOCKING STRAP

[75] Inventor: William K. Hopkins, San Clemente, Calif.

[73] Assignee: Fastening Solutions, Inc., Burbank, Calif.

[21] Appl. No.: 735,437

[22] Filed: Jan. 2, 1997

[51] Int. Cl.[6] ..... A44B 11/00

[52] U.S. Cl. ..... 24/302; 24/164; 24/336

[58] Field of Search ..... 24/301, 302, 3.11, 24/3.12, 543, 300, 306, 336, 164, 442, 3.9, 3.1; 224/250, 929, 931

[56] References Cited

U.S. PATENT DOCUMENTS

| | | | |
|---|---|---|---|
| 786,080 | 3/1905 | Wing | 24/164 |
| 1,530,342 | 3/1925 | Barber | 224/250 |
| 3,439,387 | 4/1969 | Churches | 24/300 |
| 3,486,672 | 12/1969 | Esopi | 24/302 |
| 5,083,692 | 1/1992 | Treese | 224/250 |
| 5,331,721 | 7/1994 | Raum, Sr. | 24/302 |

FOREIGN PATENT DOCUMENTS

| | | | |
|---|---|---|---|
| 0685348 | 2/1967 | Belgium | 24/302 |
| 1333646 | 6/1963 | France | 24/191 |
| 0164981 | 6/1921 | United Kingdom | 224/250 |

*Primary Examiner*—Victor N. Sakran
*Attorney, Agent, or Firm*—Oppenheimer Poms Smith

[57] ABSTRACT

A quick release locking strap for securing items in place. The strap includes an elongated flexible strap portion having a pair of adjustable quick release clamps at spaced locations on the strap portion. In one embodiment, each clamp is fixedly secured to the strap portion. In another embodiment, one clamp is fixedly secured to the strap portion and the other clamp is adapted to be secured to a surface.

7 Claims, 4 Drawing Sheets

FIG. 1
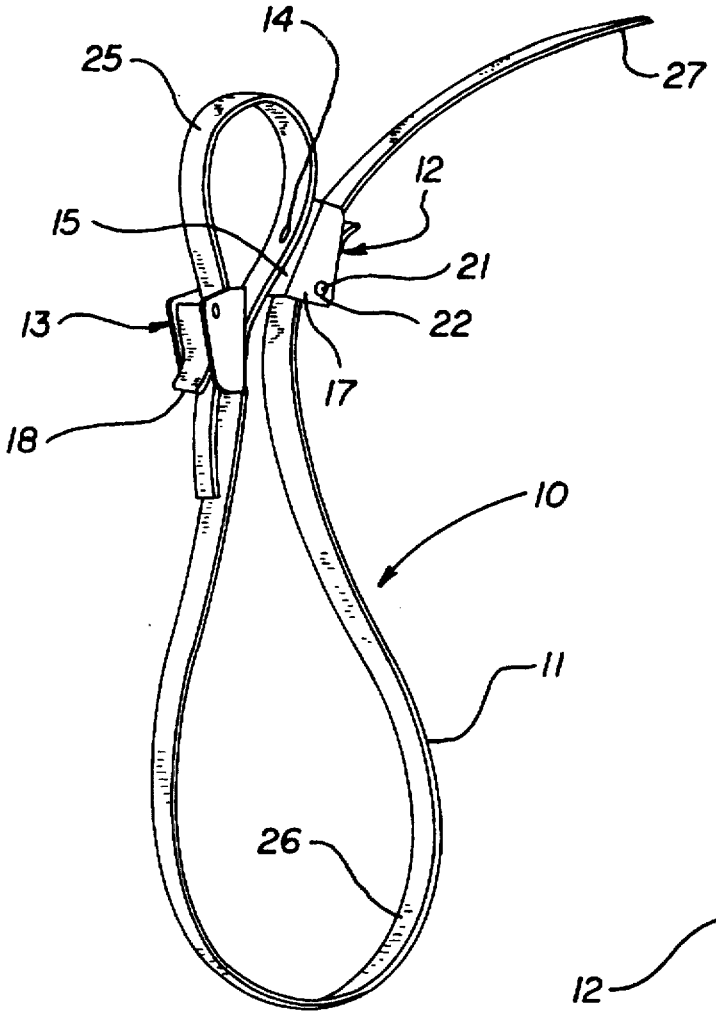
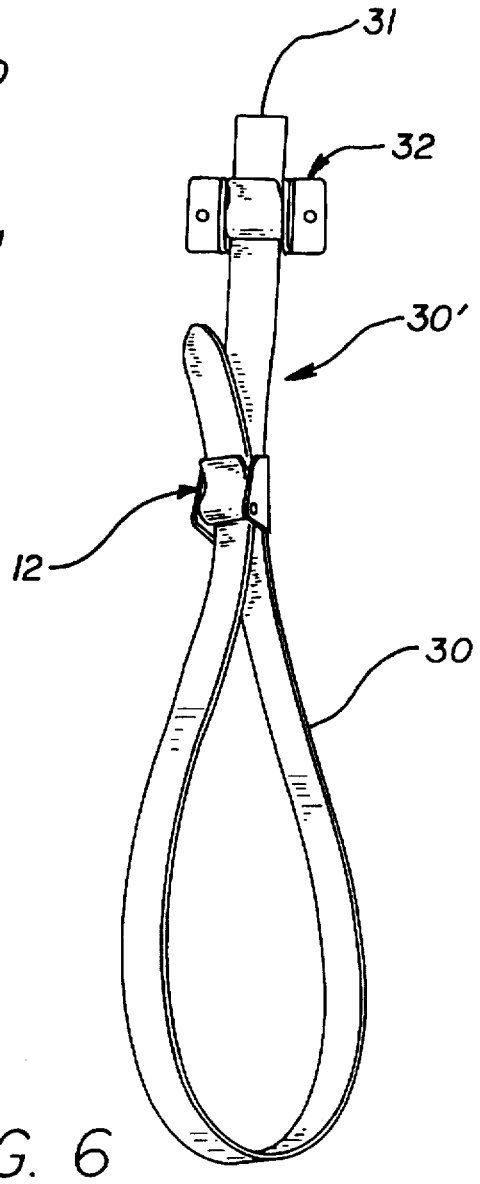
FIG. 6

FIG. 5
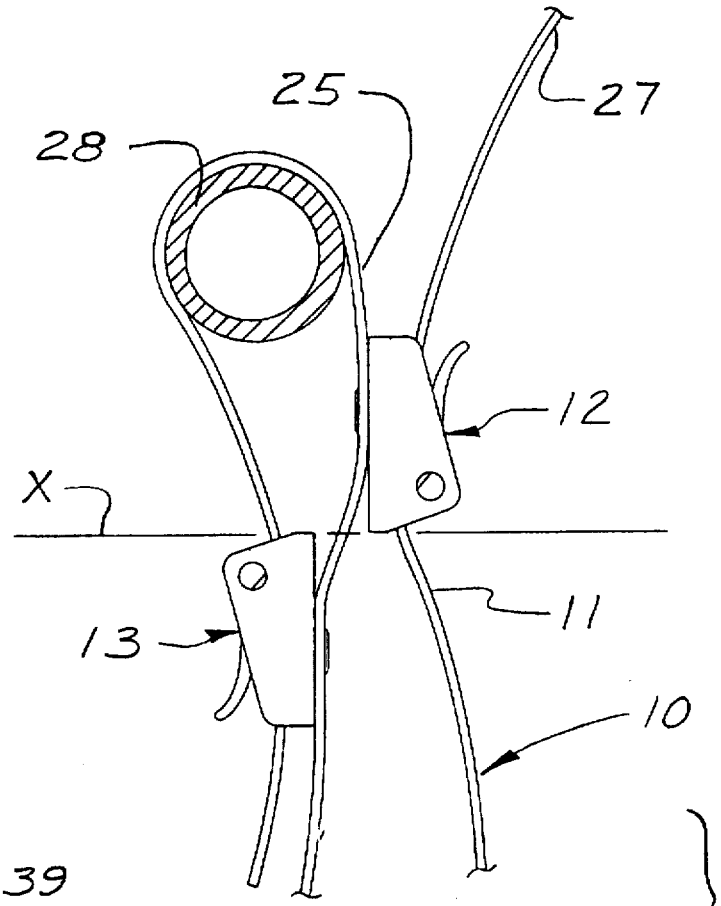
FIG. 7
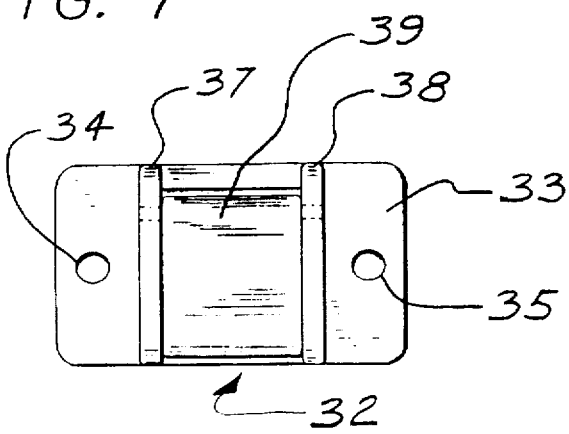
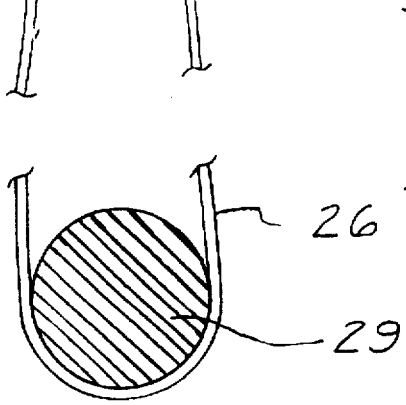
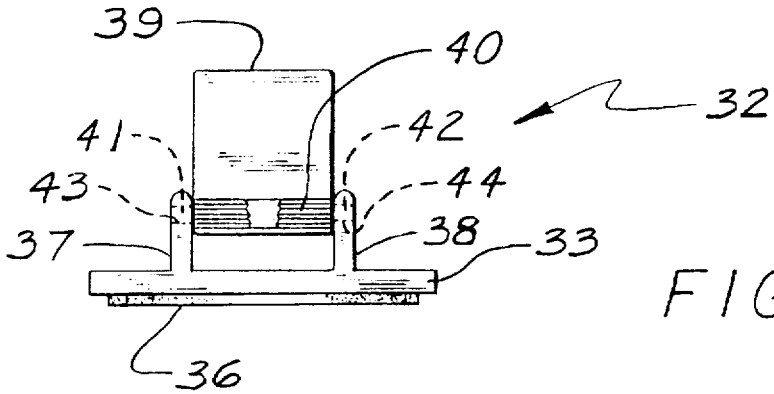
FIG. 8

QUICK RELEASE LOCKING STRAP

BACKGROUND OF THE INVENTION

1. Field of the Invention

The invention relates to locking straps; and, more particularly, to a quick release locking strap having spaced adjustable quick release clamps thereon.

2. Description of the Prior Art

Locking straps are well known in the art. Such straps generally have a flexible belt or strap portion with mating buckles at each end. The length of the strapping portion of the strap may be adjustable.

However, such buckles are not easy to lock nor quickly released, particularly in wet conditions, such as on a boat or the like. Also, some straps include parts which rust or corrode and thus are not useful in a marine environment. It is often necessary to lock such straps in a particular location, then wrap the strap about the product or device being secured. These straps must be locked in place using suitable screws or nails thus rendering them impractical where holes or the like are not desired or impractical.

There is thus a need for a quick release strap that can be quickly and easily used to secure objects in place without shifting, loosening, or falling of such objects in strong or jarring movements.

SUMMARY OF THE INVENTION

It is an object of this invention to provide a quick release securing strap having adjustable clamps thereon.

It is another object of this invention to provide such a strap which can be used to secure objects in places where spacing between the object and the place to which it is secured varies.

These and other objects are preferably accomplished by providing a strap including an elongated flexible strap portion having a pair of adjustable quick release clamps at spaced locations on the strap portion. In one embodiment, each clamp is fixedly secured to the strap portion. In another embodiment, one clamp is fixedly secured to the strap portion and the other clamp is adapted to be secured to a surface.

BRIEF DESCRIPTION OF THE DRAWING

FIG. 1 is a perspective view of a strap in accordance with the teachings of the invention;

FIG. 5 is an illustration of the strap of the invention showing formation of a pair of loops;

FIG. 6 is a perspective view of a modification of a strap in accordance with the teachings of the invention;

FIG. 7 is a top plan view of one of the clamps alone of the embodiment of FIG. 6 removed from the elongated strap portion;

FIG. 8 is an elevational view of the clamp of FIG. 7; and

DESCRIPTION OF THE PREFERRED EMBODIMENTS

Figure 2:
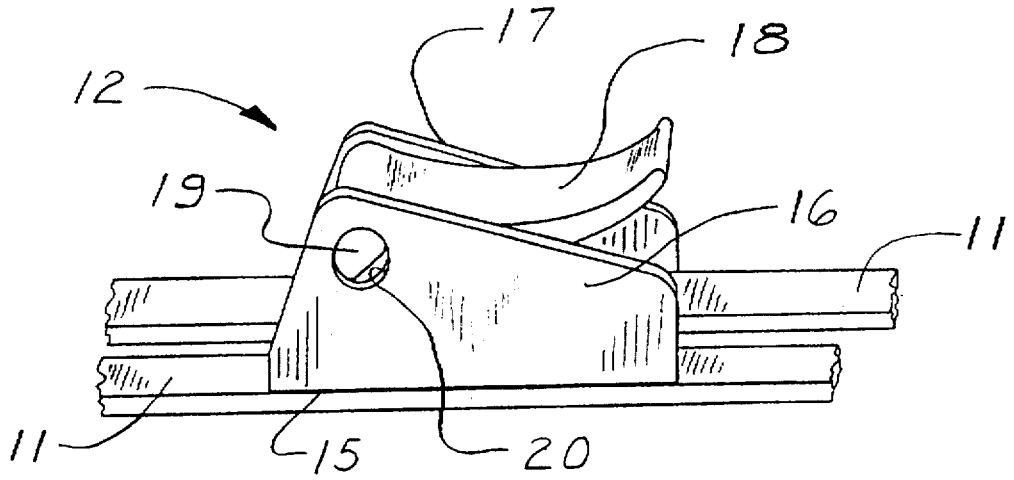
FIG. 2 is a perspective view of one of the clamps of FIG. 1 in closed position.

Referring now to FIG. 1 of the drawing, a strap 10 is shown having an elongated flexible strap portion 11. Strap portion 11 has a pair of clamps 12, 13 fixed to strap portion 11 at spaced locations adjacent one end thereof.

Figure 3:
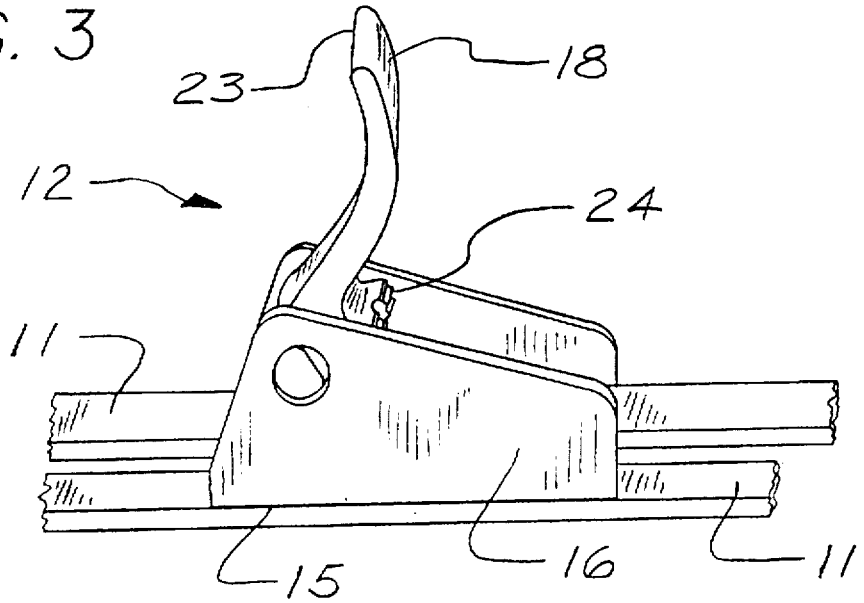
FIG. 3 is a perspective view of the clamp of FIG. 2 in open position.
Figure 4:
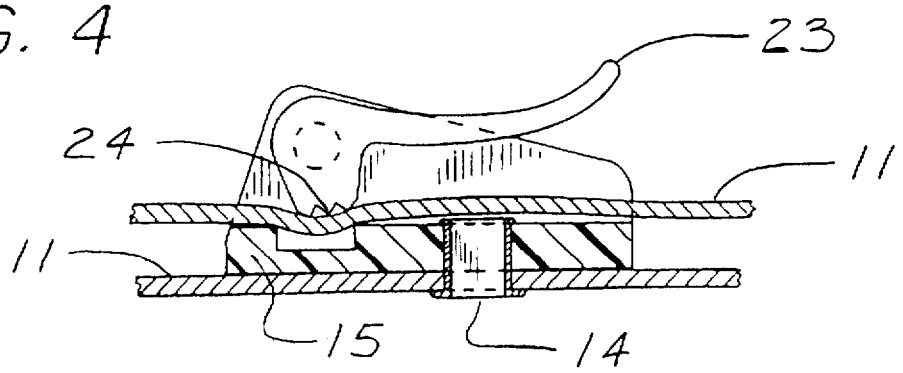
FIG. 4 is a cross-sectional view of the clamp and the elongated strap portion of the strap of the invention in closed and locked position.

Clamp 12 is shown in FIG. 2 (clamp 13 being identical). Clamp 12 is secured to strap portion 11 by a rivet 14 or the like (see FIG. 4). Clamp 12 thus includes a base portion 15 having spaced integral upstanding side walls 16, 17 (FIG. 2). A latch 18 is pivotally mounted between side walls 16, 17. Any suitable means may be used to pivotally mount latch 18. For example, latch 18 may have a pin portion 19 integral therewith extending into hole 20 formed in wall 16. In like manner, a second pin portion 21 (FIG. 1), also integral with latch 18, may extend into hole 22 in wall 17. Thus, rivet 14 secures strap portion 11 to the base portion 15. As particularly seen in FIG. 3, latch 18 terminates at one end in an upwardly curved end 23 and at the other end in a protrusion 24 (FIG. 4). As seen in FIGS. 1 to 3, strap portion 11 passes between latch 18 and base portion 15. When end 23 is grasped and latch 18 is pivoted to the FIG. 4 position, protrusion 24 abuts against strap 11 locking strap portion 11 in place.

As seen in FIG. 1, clamp 13 operates in like manner and is secured to strap portion 11 on the side opposite clamp 12. Clamp 13 is spaced a short distance from clamp 12. When strap portion 11 is inserted into clamp 13, the lever 18 of the clamp 13 is rotated to the clamping position shown to lock strap portion 11 in place. A first loop 25 is formed, the size thereof being slightly adjustable (depending on the spacing between clamps 12 and 13). A second loop 26 is formed by passing strap portion 11 through clamp 12. The size of loop 25 is also adjustable but to a greater degree than loop 25 (of course, depending on the overall length of strap portion 11).

Thus, for example, strap portion 11 may be about 48" in length, about ¾" wide and clamps 12, 13 may be spaced about 1½" apart where they are secured to strip 11 (clamp 12 being about 6½" from end 27—and clamp 13 being about 8" from end 27—FIG. 1).

FIG. 5 illustrates how strap 10 can be used to secure a post 28 to an object 29 such as a rope, hose, bicycles, etc. Loop 25 extends about post 28 and clamp 13 may be adjusted to tighten the same. Loop 26 extends about object 29 and strap portion 11, passing through clamp 12, can be adjusted to tighten the same. Also as seen in FIG. 5, the fronts of each clamp 12, 13 are aligned along axis x.

It can be seen that there is disclosed a single length of strap portion 11 with two cam lock clamps 12, 13 affixed to the strap portion 11 on opposite sides, and facing in opposite directions. The front end of both clamps 12, 13 are aligned with each other. The clamps 12, 13 are located at a distance from the ends of the strap portion 11 to allow a loop to be formed between the end of each clamp 12, 13 and the extending end of the strap portion 11. Both ends of the strap portion 11 can be fed through their corresponding clamp on the strap portion 11 and "locked" into place, by so doing forming a figure eight. Either end of the strapped portion 11 can be adjusted for desired tension, and fastened accordingly as seen in FIG. 5.

The strap 10 of FIGS. 1 to 5 provide a single strap portion 11 that can be wrapped and fastened tightly around a post or rail (vertical or horizontal) of varied diameters, as seen in FIG. 5, leaving the other end of the strap free for quick release "open/close" fastening of objects using the second clamp. The strap portion 11 can be moved and refastened easily for use at different locations.

A second embodiment of the invention is shown in FIG. 6 wherein like numerals refer to like parts of the embodiment of FIGS. 1 to 5. Here, strap 30' differs from the strap 10 since only one clamp 12 is fixed to strap 30 similarly to the attachment of clamp 12 to strap portion 11. Clamp 12 is fixed to strap portion 30 about 5" to 6" or so from end 31. Instead of clamp 13, a removable clamp 32 is provided. As seen in FIGS. 7 and 8, clamp 32 has a generally rectangular base portion 33 with a pair of spaced holes 34, 35 therethrough for receiving screws or the like (not shown) for securing base portion 33 to a desired location. Alternatively, an adhesive pad 36 (FIG. 8) may be provided on the underside of base portion 33 for removably attaching the same to a supporting surface.

A pair of spaced side walls 37, 38, similar to side walls 16, 17, extend upwardly from base portion 33. A lever 39, identical to level 18, and having a like protrusion 40, is pivotally mounted between walls 16, 17 by pins 41, 42, in holes 43, 44, respectively. Strap portion 30 thus passes through clamp 32, between base portion 33 and protrusion 40, as seen in FIG. 6 and is secured at any desired location.

Figure 9:
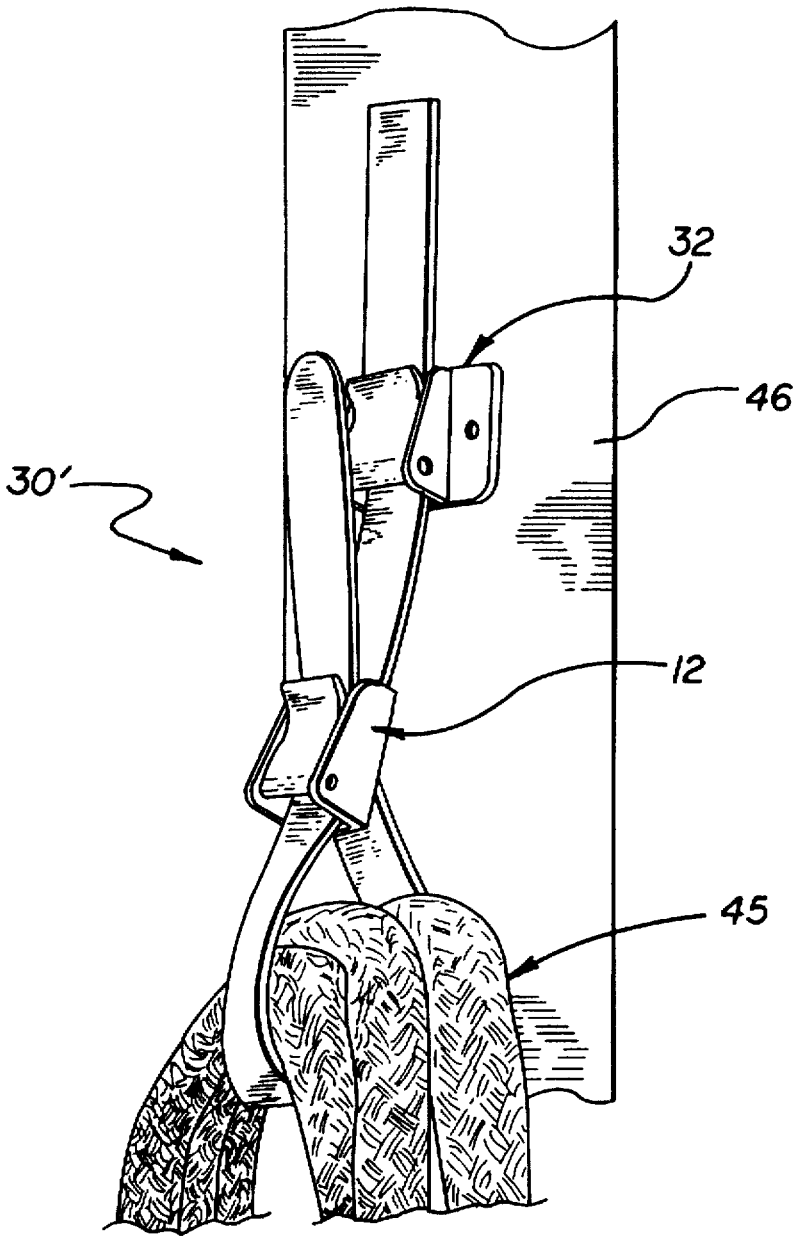
FIG. 9 is a perspective view illustrating the operation of the strap of FIG. 6.

As seen in FIG. 9, strap 30' can be provided with a loop formed by clamp 12 encircling a rope 45 (or any suitable object) with clamp 32 secured to wall 46 (or any suitable surface). The strap 30' can be adjusted with respect to wall 46 varying the distance between clamps. Thus, strap 30' has clamps 12, 32 affixed to the top of strap portion 30' The location of the clamp 12 on the strap portion 30 results in a shorter end and a longer end of strap portion 30 extending beyond the front and rear of the clamp 12. The front end of the clamp 12 faces toward the longer end of strap portion 30. The long end of the strap portion 30 can be fastened around an object in a loop, such as rope 45, with the strap end being fed through the front of clamp 32 and "locked" into place. The strap portion 30 can be adjusted for a desired tension around an object, such as rope 45, and fastened accordingly. The short end of the strap portion 30 can be locked and released by other clamps that hold the fastening strap in place at desired locations for use.

The working end of the strap provides a quick release "open and close" clamp of objects wherever needed. A fastened object can be released for use and refastened when finished, or moved to a different location without loosening the wrap or stowed away, always ready for use. Additional open and close clamps can be used to hold the strap at more than one location. When the strap is removed, the low profile clamps are hardly noticeable.

It can be seen that straps 10 and 30' can be used to protect freestanding equipment against movement, such as ocean or vehicle movement, in storms, etc. The quick release straps are strong, safe, and secure and made of materials, such as plastic, which will not corrode in marine environments.

The adhesive pads 36 may be any suitable type and straps 10, 30' may be any suitable length, such as 22". The straps 10, 30' are adjustable and easy to clean. The straps 10, 30' may be used to secure deck chairs and furniture restraints, boat fenders, boat lines, lanyards, sheets, anchor lines, power cords, water hoses, life rings, boarding ladders, bike straps, rack straps, boat hooks, spars, mooring lines, fishing rods, coolers, portable containers, life jackets, etc.

Although a particular embodiment of the invention has been disclosed, variation thereof may occur to an artisan and the scope of the invention should be considered only as limited by the scope of the claims.

I claim:

1. A quick release locking strap comprising:

a single integral elongated strap portion of flexible material;

a first clamp fixedly secured to said strap portion remote from one end thereof; and a second clamp mounted on said strap portion spaced from said first clamp, each of said clamps having a base portion, each of said base portions having a forward end and a rearward end, each of said clamps having a locking lever pivotally mounted thereon adjacent the forward end of its respective clamp, each of said locking levers being spaced from its respective base portion with said strap portion being disposed between said locking lever and said base portion, each of said locking levers having camming means thereon movable between a first position allowing said strap portion to slide through said clamp to a second position abutting against said strap portion thereby locking said clamp to said strap portion, said first clamp being closer to one end of said strap portion than the other with a first loop formed in said strap portion with said camming means of said first clamp abutting against said strap portion, said second clamp being fixed to said strap portion on the side of said strap portion opposite where said first clamp is fixed to said strap portion, the front ends of each of said clamps extending in opposite directions and disposed adjacent each other and including a second loop bigger in inner diameter than said first loop formed in said strap portion with said camming means of said second clamp abutting against said strap portion.

2. In the strap of claim 1 wherein said strap portion is about 30" long and said first clamp is fixed to said strap portion about 8" from one end thereof.

3. In the strap of claim 2 wherein said second clamp is fixed to said strap portion about 6" from said one end thereof on the side of said strap portion opposite where said first clamp is fixed to said strap portion, the forward ends of said clamps facing opposite directions.

4. In the strap of claim 1 wherein said second clamp is removably mounted on said strap portion.

5. In the strap of claim 4 wherein said strap portion has a short end and a long end, said second clamp being mounted on said strap portion between said first clamp and the terminal end of said short end.

6. In the strip of claim 4 wherein said second clamp has an adhesive pad on the underside of said base portion.

7. In the strap of claim 4 wherein said strap portion is about 26" long and said first clamp is fixed to said strap portion about 5" from one end thereof.

* * * * *